US007880692B2

(12) United States Patent
Wang

(10) Patent No.: US 7,880,692 B2
(45) Date of Patent: Feb. 1, 2011

(54) DRIVER CIRCUIT OF AMOLED WITH GAMMA CORRECTION

(75) Inventor: Chen Yu Wang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 961 days.

(21) Appl. No.: 11/621,118

(22) Filed: Jan. 9, 2007

(65) Prior Publication Data

US 2008/0165165 A1 Jul. 10, 2008

(51) Int. Cl.
*G09G 3/30* (2006.01)
*G09G 3/32* (2006.01)

(52) U.S. Cl. ..... 345/76; 345/82

(58) Field of Classification Search ..... 345/36, 345/39, 44–46, 76–83, 204, 208, 210–213; 315/169.3; 313/463, 504; 307/98; 323/209
See application file for complete search history.

(56) References Cited

U.S. PATENT DOCUMENTS 4,344,050 A * 8/1982 Callahan ..... 333/173
4,743,872 A * 5/1988 Tanimoto ..... 333/173
2005/0057457 A1* 3/2005 Date ..... 345/76
2005/0174306 A1* 8/2005 Agari et al. ..... 345/76

* cited by examiner

*Primary Examiner*—Bipin Shalwala
*Assistant Examiner*—Keith Crawley
(74) *Attorney, Agent, or Firm*—WPAT, P.C.; Anthony King

(57) ABSTRACT

A driver circuit of an AMOLED (active matrix organic light emitting diode) with gamma correction includes a voltage selector, an operational amplifier, a MOS transistor, and a resistive element. The voltage selector selects one of a plurality of gamma voltages. The operational amplifier receives the selected gamma voltage and a feedback signal to generate a control signal. The MOS transistor provides the feedback signal and conducts a current associated with a current type pixel circuit in response to the control signal. The resistive element is coupled to a first voltage end and an inverted input end of the operational amplifier for determining the current with the selected gamma voltage.

14 Claims, 7 Drawing Sheets

DRIVER CIRCUIT OF AMOLED WITH GAMMA CORRECTION

BACKGROUND OF THE INVENTION

1. Field of the Invention

The present invention relates to a driver circuit of an AMOLED (active matrix organic light emitting diode) with gamma correction, and more particularly, to a driver circuit of a current type AMOLED with gamma correction.

2. Description of the Related Art

Gamma correction is used to control the overall brightness of images shown on a display device. Images that are not properly corrected can look either bleached out or too dark. Generally, the optical characteristics of panel modules such as an LCD (liquid crystal display) and an electroluminescence panel have a nonlinear light transmission characteristic with respect to an applied voltage. Therefore, the drive circuit should drive the panel modules after the gamma correction is performed to correct the voltage in such a way as to match with the nonlinear light transmission characteristic of the panel modules. FIG. 1 illustrates a typical gamma correction curve with a gamma value of 2.2, in which both the x-axis (gray scale) and y-axis (relative luminance) are normalized. The applied voltage corresponding to a specific gray level is inputted into the panel module and then a relative luminance that is based on the gamma correction curve of FIG. 1 and corresponds to a specific light transmission is outputted.

FIG. 2 shows a conventional driver circuit 10 used in an LCD driver or in a voltage type AMOLED (active matrix organic light emitting diode) driver. The driver circuit 10 includes a gamma correction circuit 11, plural digital-to-analog converters $DAC_1$-$DAC_M$, and plural operational amplifier buffers OPB. Each digital-to-analog convert $DAC_i$ receives a digital code (i.e., a gray level or a pixel value) $DGL_i$, and generates an analog driving signal $ADS_i$ in accordance with a reference voltage $V_i$ generated from the gamma correction circuit 11. The analog driving signal $ADS_i$ is sent to drive the LCD panel or the voltage type AMOLED panel through the corresponding operational amplifier buffer OPB. The gamma correction circuit 11 includes plural resistors $R_i$ connected in series between a high-potential power supply VH and a low-potential power supply VL, which is also called an R-string. It is easy to perform the gamma correction by the R-string configuration. The proper reference voltages $V_i$ can be obtained by merely adjusting the resistances of the resistors $R_i$ of the R-string to produce the desired gamma correction curve shown in FIG. 1 or the like. However, for a current type AMOLED driver, it is not so easy to achieve the desire gamma correction curve by the R-string.

FIG. 3 shows a conventional driver circuit 20 used in a current type AMOLED driver with a four-bit resolution. The driver circuit 20 includes plural groups of current mirrors. Each group of current mirrors includes four PMOS transistors and four corresponding switches b3-b0. For the current type AMOLED, the luminance thereof is proportional to the driving current flowing to the current type AMOLED. The arrangement of states (ON or OFF) of the four switches b3-b0 presents 16 different states to provide 16 levels of current to drive an AMOLED circuit. The switches b3 and b0 correspond to the MSB (most significant bit) and the LSB (least significant bit) of a digital input gray code, respectively. Therefore, the magnitude of the driving current is linearly dependent upon the pixel value. The driver circuit 20 can not achieve a non-linear gamma curve shown in FIG. 1.

FIGS. 4(*a*) and 4(*b*) show two relationship curves C1 and C2 (equivalent to gamma correction curves) between the driving current and the gray scale (six-bit resolution, for example) of two conventional driver circuits 20 with a small current scale and a large current scale, respectively. Another approach like the conventional driver circuit 20 is proposed, which combines FIGS. 4(*a*) and 4(*b*) to form FIG. 4(*c*). That is, the relationship curve C3 in FIG. 4(*c*) is a superposed curve of the relationship curves C1 and C2. However, the relationship curve C3 still cannot fit the desired gamma correction curve of FIG. 1. Therefore, this approach also fails to perform the gamma correction, and it is necessary to develop a driver circuit with gamma correction to drive a current type AMOLED.

SUMMARY OF THE INVENTION

An aspect of the present invention is to provide a driver circuit of a current type AMOLED with gamma correction to obtain a desired gamma correction curve.

The present invention discloses a driver circuit of a current type AMOLED with gamma correction, which includes an operational amplifier, a MOS transistor and a resistive element (or an impedance). The operational amplifier receives a gamma voltage selected by a voltage selector and a feedback signal to generate a control signal. The MOS transistor provides the feedback signal and conducts a current associated with a current type pixel circuit in response to the control signal. The resistive element is coupled to a first voltage end and an inverted input end of the operational amplifier for determining the current with the gamma voltage.

The present invention also discloses a driver circuit according to the present invention, which provides a driving current of a pixel according to a pixel value. The driver circuit includes an impedance having one end coupled to receive a supply voltage and the other end coupled to a reference node, and a MOS transistor having a first end coupled to the pixel and a second end coupled to the reference node, wherein a gate of the MOS transistor is connected so that the MOS transistor conducts a driving current for the pixel when a reference voltage corresponding to the pixel value is applied to the reference node. The driver circuit further includes an operational amplifier having a non-inverted input end coupled to receive the reference voltage, an inverted input end coupled to the reference node and an output end coupled to control the MOS transistor, wherein the reference voltage also exhibits at the inverted input through virtual connection between two input ends of the operational amplifier.

BRIEF DESCRIPTION OF THE DRAWINGS

The invention will be described according to the appended drawings in which:

FIG. 4(*c*) shows a superposed curve of FIGS. 4(*a*) and 4(*b*);

FIG. 5(*b*) shows another embodiment of the resistive element of FIG. 5(*a*);

FIG. 6(*b*) shows another embodiment of the resistive element of FIG. 6(*a*).

DETAILED DESCRIPTION OF THE INVENTION

Figure 1:
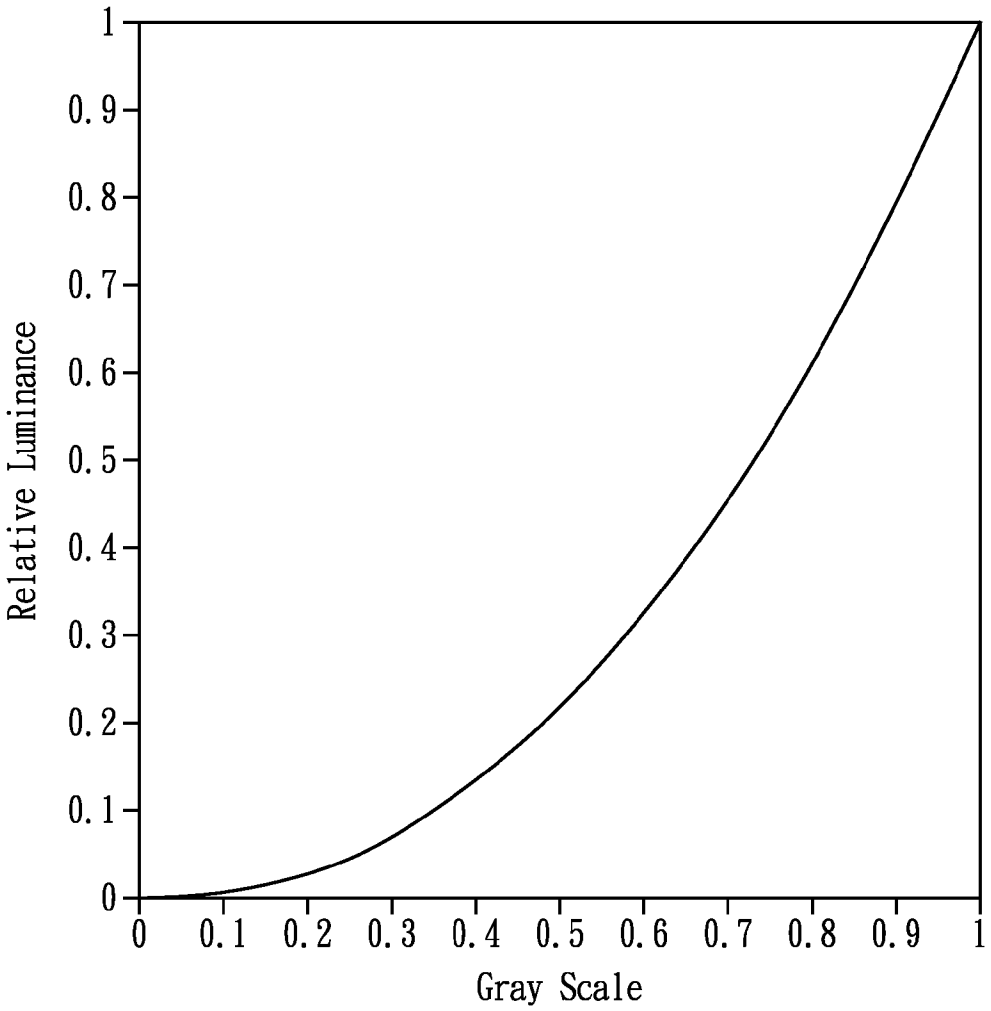
FIG. 1 illustrates a typical gamma correction curve with a gamma value of 2.2.
Figure 2:
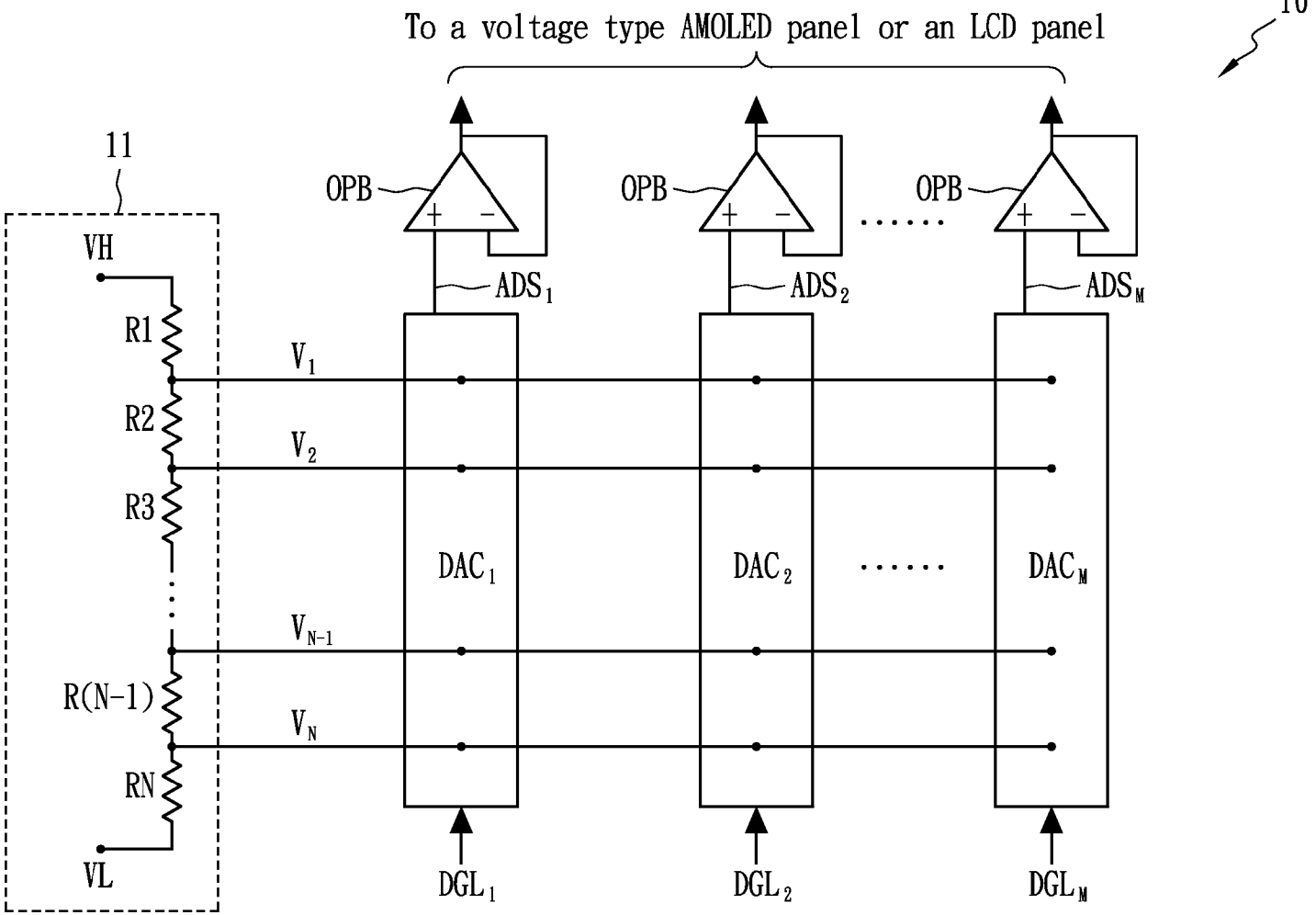
FIG. 2 (Prior Art)
FIG. 2 shows a conventional driver circuit used in an LCD driver or in a voltage type AMOLED driver.
Figure 3:
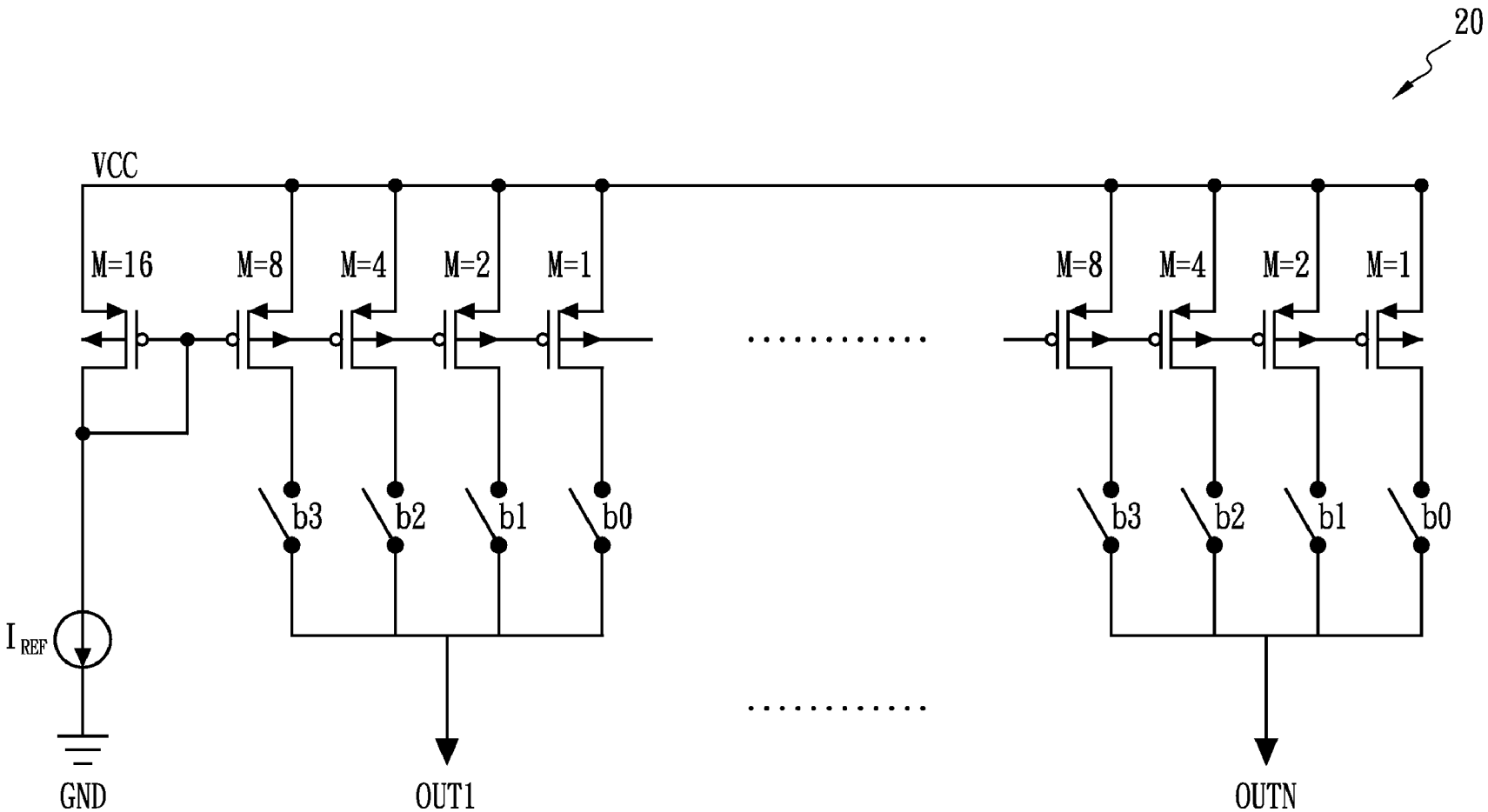
FIG. 3 (Prior Art)
FIG. 3 shows a conventional driver circuit used in a current type AMOLED.
Figure 4A:
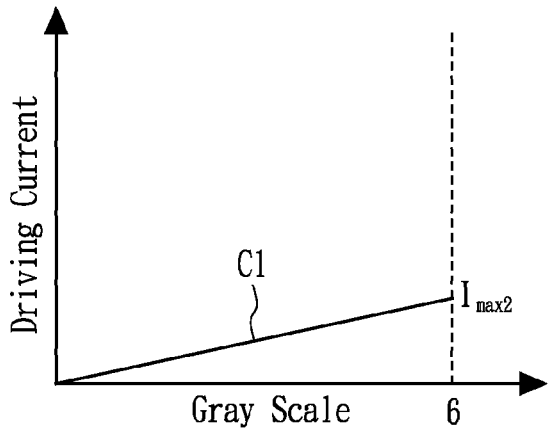
FIG. 4(a) (Prior Art)
FIGS. 4(*a*)-4(*b*) show two relationship curves between the driving current and the gray scale of two conventional driver circuits.
Figure 4B:
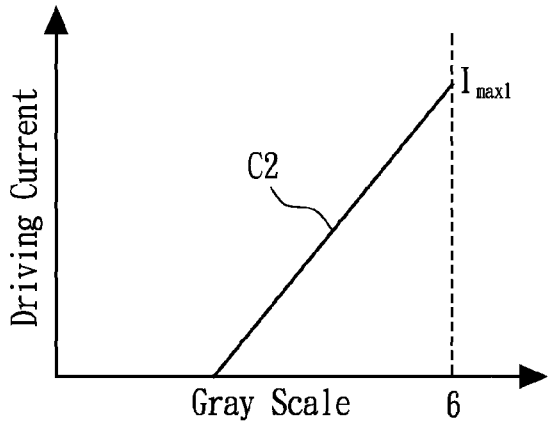
FIG. 4(b) (Prior Art)
Figure 4C:
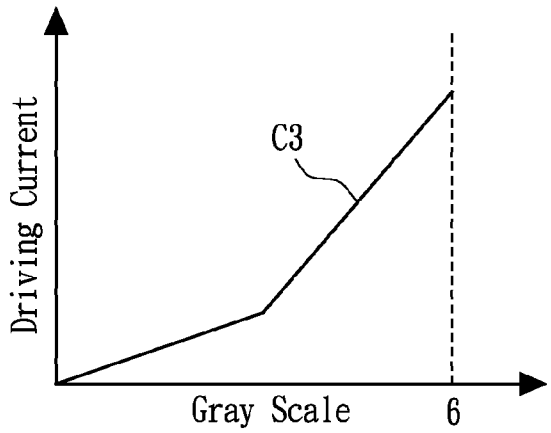
FIG. 4(c) (Prior Art)
Figure 5A:
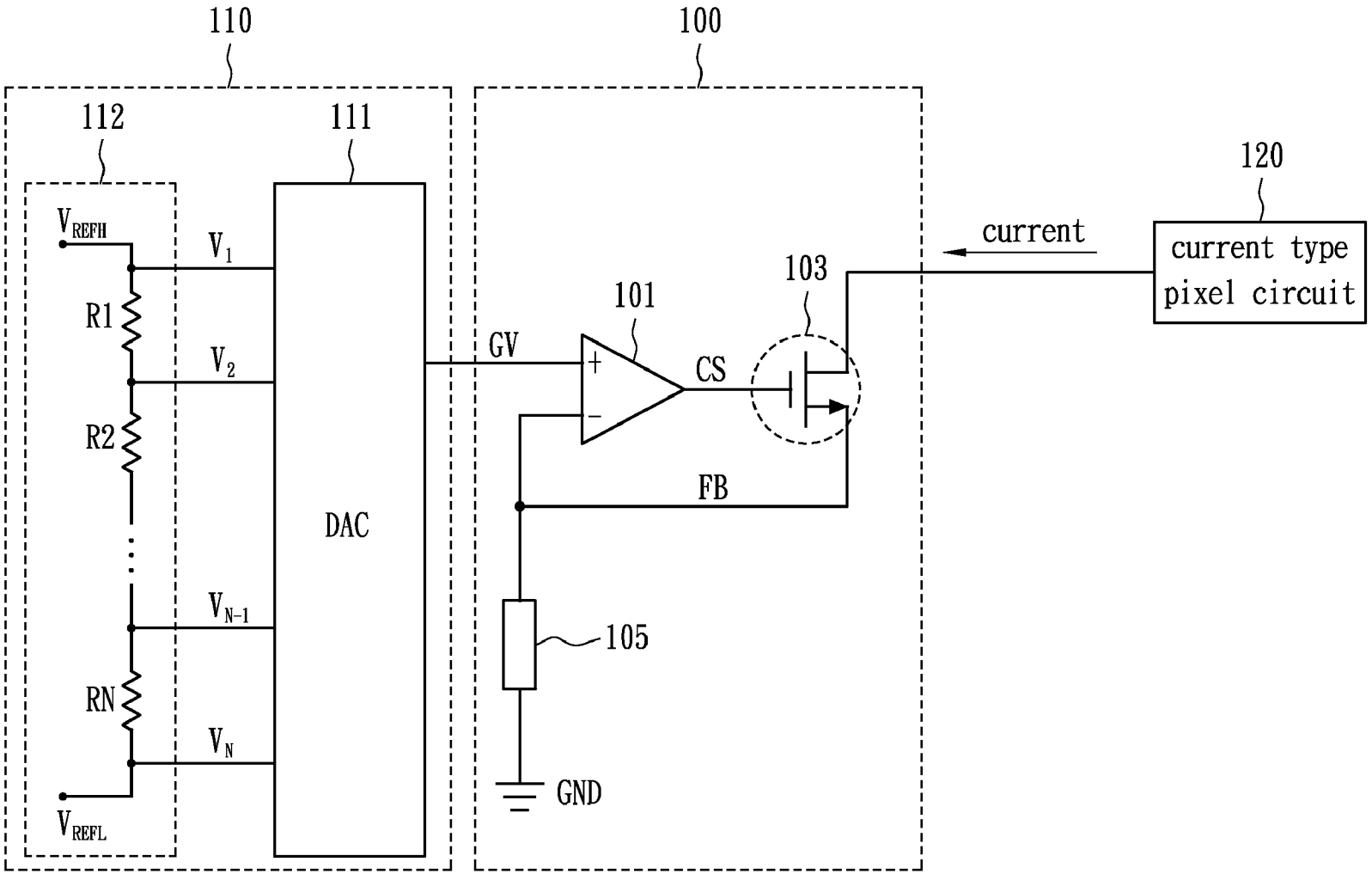
FIG. 5(*a*) shows one embodiment of a driver circuit in accordance with the present invention, a voltage selector and a current type pixel circuit thereof.
Figure 5B:
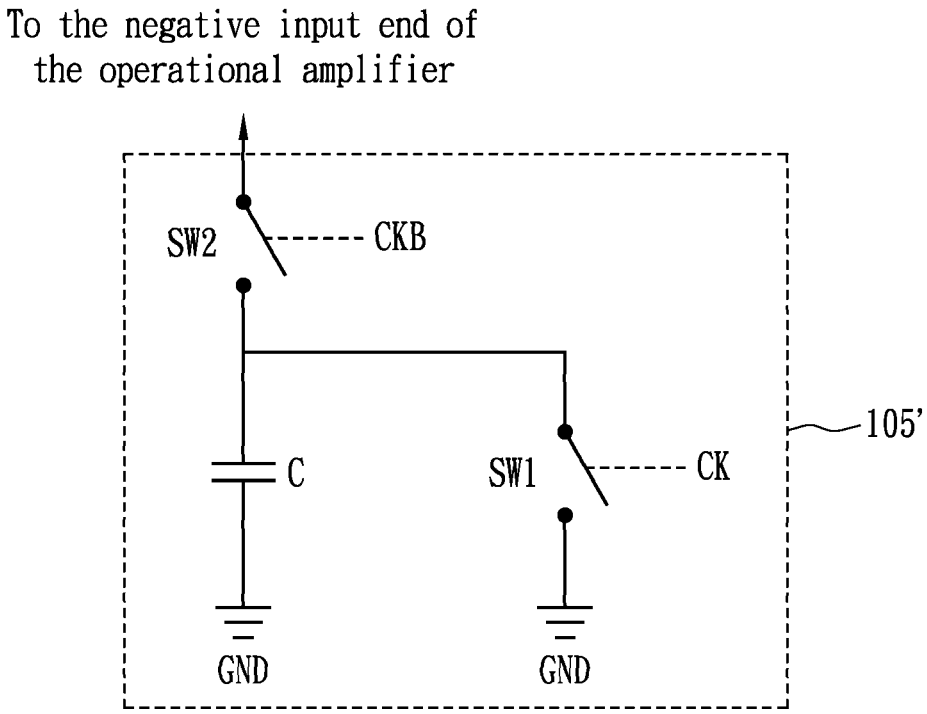

FIG. 5(*a*) shows one embodiment of a driver circuit 100 of a current type AMOLED with gamma correction in accordance with the present invention, and a voltage selector 110 and a current type pixel circuit 120 thereof. The driver circuit 100 includes an operational amplifier 101, a MOS transistor 103 (an NMOS transistor in the current embodiment), and a resistive element 105. The operation of the driver circuit 100 is given below. The operational amplifier 101 receives a gamma voltage GV of a voltage selector 110 and a feedback signal FB to generate a control signal CS, wherein the gamma voltage GV is selected according to a pixel value of the pixel circuit 120. The MOS transistor 103 provides the feedback signal FB and conducts a current from a current type pixel circuit 120 in response to the control signal CS. The resistive element 105 has one end coupled to a first voltage end GND (a ground voltage in the current embodiment) that is lower than the gamma voltage GV. Another end of the resistive element 105 is coupled to an inverted end of the operational amplifier 101. There is no difference between the voltage level of the gamma voltage GV and that of the feedback signal FB due to virtual connection of the two input ends of the operational amplifier 101 resulting from the negative feedback. Therefore, the current flowing from the current type pixel circuit 120 to the ground voltage GND can be determined by the gamma voltage GV divided by the resistance of the resistive element 105. The inverted end of the operational amplifier 101 could be regarded as a reference node for generation of the driving current of the pixel circuit 120. The reference node receives a reference voltage when the gamma voltage GV is applied to the reference node through the virtual connection between the two input ends of the operational amplifier 101. The MOS transistor 103 operates in the saturation mode when the gamma voltage GV is applied to the reference node. Thus, the driving current drawn from the pixel circuit 120 corresponds to the gamma voltage GV. The resistive element 105 is a resistor in the current embodiment.

The voltage selector 110 includes a voltage divider 112 and a digital-to-analog converter (DAC) 111. The voltage divider 112 contains plural resistors R1-RN connected in series, a high reference voltage $V_{REFH}$ coupled to one end of the resistor R1 and a low reference voltage $V_{REFL}$ coupled to one end of the resistor RN. The voltage divider 112 provides plural voltage levels $V_1$-$V_N$ to the DAC 111.

FIG. 5(*b*) shows another embodiment of the resistive element of FIG. 5(*a*). The resistive element 105' includes a first switch SW1, a capacitor C and a second switch SW2. The first switch SW1 is controlled by a clock signal CK. The capacitor C is connected to the first switch SW1 in parallel, and one end of the capacitor C is connected to the first voltage end GND. The second switch SW2 is connected between the other end of the capacitor C and the inverted input end of the operational amplifier 101. The second switch SW2 is controlled by an inverse clock signal CKB.

Figure 6B:
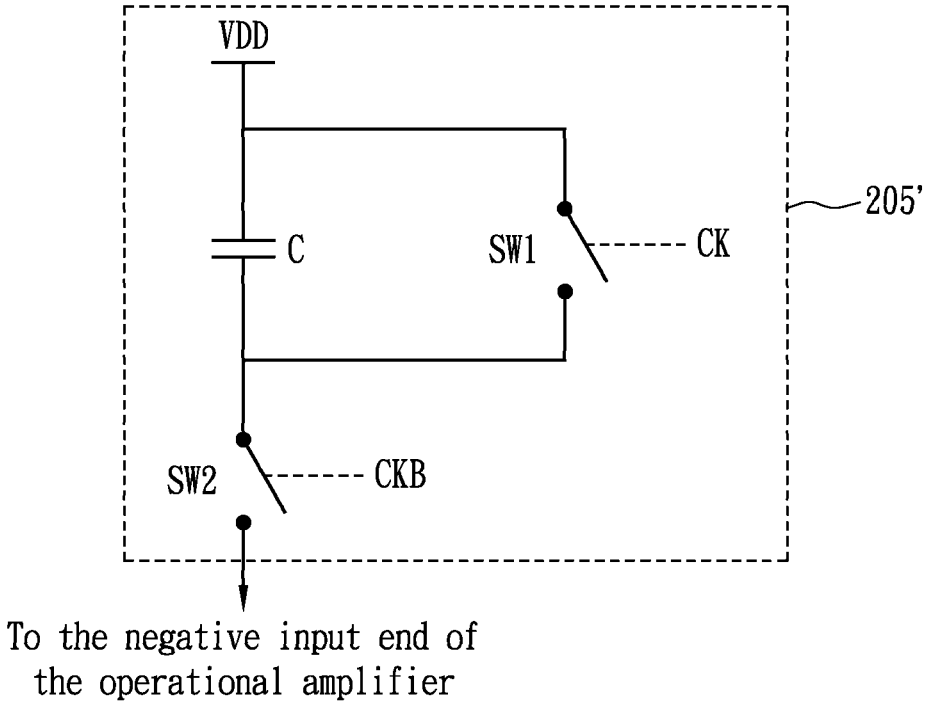
FIG. 6(*a*) shows another embodiment of a driver circuit in accordance with the present invention, a voltage selector and a current type pixel circuit thereof.
Figure 6A:
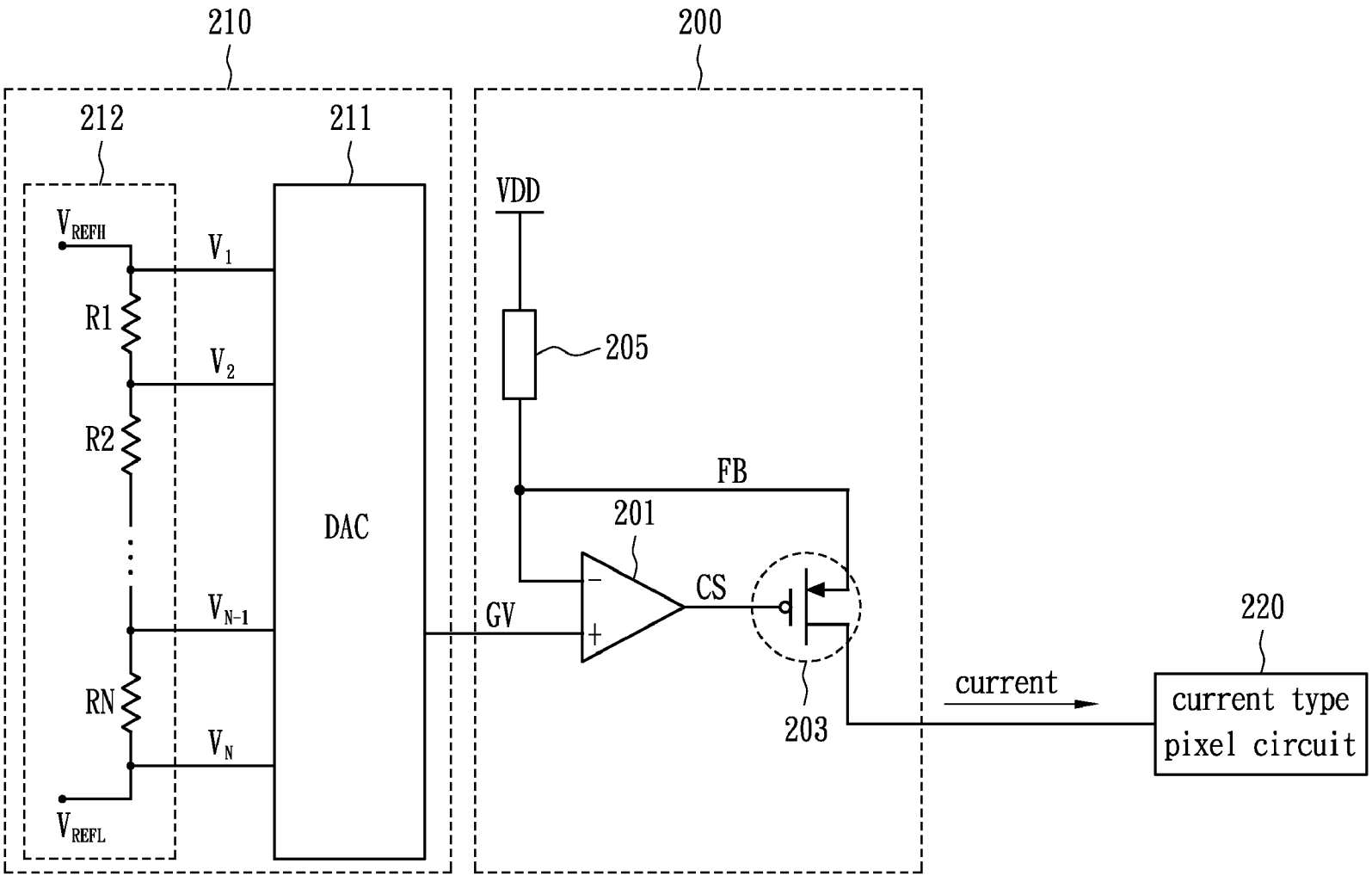

FIG. 6(*a*) shows another embodiment of a driver circuit 200 of a current type AMOLED with gamma correction in accordance with the present invention, and a voltage selector 210 and a current type pixel circuit 220 thereof. The driver circuit 200 includes an operational amplifier 201, a MOS transistor 203 (a PMOS transistor in the current embodiment), and a resistive element 205. The operation of the driver circuit 200 is given below. The operational amplifier 201 receives a gamma voltage GV of a voltage selector 210 and a feedback signal FB to generate a control signal CS, wherein the gamma voltage GV is selected according to a pixel value of the pixel circuit 220. The MOS transistor 203 provides the feedback signal FB and conducts a current to a current type pixel circuit 120 in response to the control signal CS. The resistive element 205 has one end coupled to a first voltage end VDD (a supply source in the current embodiment) that is higher than the gamma voltage GV. Another end of the resistive element 205 is coupled to an inverted end of the operational amplifier 201. There is no difference between the voltage level of the gamma voltage GV and that of the feedback signal FB due to virtual connection of the two input ends of the operational amplifier 201 resulting from the negative feedback. Therefore, the current flowing from the supply source VDD into the current type pixel circuit 220 can be determined by the gamma voltage GV divided by the resistance of the resistive element 205. The inverted end of the operational amplifier 201 could be regarded as a reference node for generation of the driving current of the pixel circuit 220. The reference node receives a reference voltage when the gamma voltage GV is applied to the reference node through the virtual connection between the two input ends of the operational amplifier 201. The MOS transistor 203 operates in the saturation mode when the gamma voltage GV is applied to the reference node. Thus, the driving current flowing into the pixel circuit 220 corresponds to the gamma voltage GV. The resistive element 205 is a resistor in the current embodiment. The structure of the voltage selector 210 is identical to that of the voltage selector 110, and thus its description is skipped here.

FIG. 6(*b*) shows another embodiment of the resistive element of FIG. 6(*a*). The resistive element 205' includes a first switch SW1, a capacitor C and a second switch SW2. The first switch SW1 is controlled by a clock signal CK. The capacitor C is connected to the first switch SW1 in parallel, and one end of the capacitor C is connected to the first voltage end VDD. The second switch SW2 is connected between the other end of the capacitor C and the inverted input end of the operational amplifier 201. The second switch SW2 is controlled by an inverse clock signal CKB.

The above-described embodiments of the present invention are intended to be illustrative only. Numerous alternative embodiments may be devised by those skilled in the art without departing from the scope of the following claims.

What is claimed is:

1. A driver circuit of an AMOLED with gamma correction, comprising:

a voltage selector selecting one of a plurality of gamma voltages;

an operational amplifier receiving the selected gamma voltage and a feedback signal to generate a control signal;

a MOS transistor providing the feedback signal and conducting a current associated with a current type pixel circuit in response to the control signal; and a resistive element coupled to a first voltage end and an inverted input end of the operational amplifier for determining the current with the selected gamma voltage, wherein the resistive element comprises:

a first switch controlled by a clock signal;

a capacitor connected to the first switch in parallel, and one end of the capacitor connected to the first voltage end;

a second switch connected between the other end of the capacitor and the inverted input end of the operational amplifier, and controlled by an inverse clock signal;

wherein the second switch is both an input and an output of the resistive element; and wherein there is no output capacitor associated with said output.

2. The driver circuit of an AMOLED with gamma correction of claim 1, wherein the first voltage end is a ground lower than the selected gamma voltage, and the MOS transistor is an NMOS transistor.

3. The driver circuit of an AMOLED with gamma correction of claim 2, wherein the current flows from the current type pixel circuit to the ground.

4. The driver circuit of an AMOLED with gamma correction of claim 2, wherein the NMOS transistor receives the control signal at the gate thereof, provides the feedback signal at the source thereof and receives the current at the drain thereof.

5. The driver circuit of an AMOLED with gamma correction of claim 1, wherein the first voltage end is a supply source higher than the selected gamma voltage, and the MOS transistor is a PMOS transistor.

6. The driver circuit of an AMOLED with gamma correction of claim 5, wherein the current flows from the supply source to the current type pixel circuit.

7. The driver circuit of an AMOLED with gamma correction of claim 5, wherein the PMOS transistor receives the control signal at the gate thereof, provides the feedback signal at the source thereof and provides the current at the drain thereof.

8. The driver circuit of an AMOLED with gamma correction of claim 1, wherein the resistive element is a resistor.

9. The driver circuit of an AMOLED with gamma correction of claim 1, wherein the current is equal to the selected gamma voltage divided by the resistance of the resistive element.

10. A driver circuit providing a driving current of a pixel according to a pixel value, comprising:

a voltage selector selecting one of a plurality of gamma voltages;

an impedance having one end coupled to receive a supply voltage and the other end coupled to a reference node; and a transistor having a drain coupled to the pixel and a source coupled to the reference node;

wherein a gate of the transistor is connected so that the transistor conducts a driving current for the pixel when a reference voltage corresponding to the pixel value is applied to the reference node, wherein the impedance comprises:

a first switch controlled by a clock signal and having a first end coupled to the reference node;

a capacitor having one end coupled to a second end of the first switch and the other end coupled to receive the supply voltage;

a second switch controlled by an inverted signal of the clock signal, and having one end coupled to the second end of the first switch and the other end coupled to receive the supply voltage;

wherein the second switch is both an input and an output of the impedance; and wherein there is no output capacitor associated with said output.

11. The driver circuit of claim 10 further comprising an operational amplifier having a non-inverted input end coupled to receive the reference voltage, an inverted input end coupled to the reference node and an output end coupled to the gate of the transistor.

12. The driver circuit of claim 11, wherein the impedance is a resistor.

13. The driver circuit of claim 10, wherein the supply voltage is a ground voltage and the driving current is drawn from the pixel.

14. The driver circuit of claim 10, wherein the supply voltage is a supply source and the driving current flows into the pixel.

* * * * *